United States Patent [19]

Gotto

[11] Patent Number: 4,542,828

[45] Date of Patent: Sep. 24, 1985

[54] HYGIENE IMPLEMENT

[76] Inventor: Raymond J. Gotto, 10 The Grove, Patchway, Bristol, Avon, United Kingdom

[21] Appl. No.: 521,042

[22] Filed: Aug. 8, 1983

[30] Foreign Application Priority Data

Aug. 16, 1982 [GB] United Kingdom ..... 8223560
Jun. 20, 1983 [GB] United Kingdom ..... 8316686

[51] Int. Cl.[4] ..... A45D 44/18; B65D 85/00

[52] U.S. Cl. ..... 206/581; 206/38; 206/228; 206/823; 132/76.2; 132/80 R; 30/34 R; 30/41

[58] Field of Search ..... 206/38, 226, 228, 234, 206/581, 823; 132/76.2, 79 R, 80 R; 30/34 R, 41, 47, 86

[56] References Cited

U.S. PATENT DOCUMENTS

| | | | |
|---|---|---|---|
| 793,259 | 6/1905 | Wilson | 206/38 R |
| 1,268,930 | 6/1918 | Cook | 132/76.2 |
| 1,392,753 | 10/1921 | Franck | 132/80 R |
| 1,892,836 | 1/1933 | Harvey | 30/41 |
| 2,168,689 | 8/1939 | Smith et al. | 206/38 R |
| 2,276,766 | 3/1942 | De Witt | 206/440 |
| 2,454,374 | 11/1948 | Bowlin | 132/80 R |
| 2,599,019 | 6/1952 | Rupert | 132/80 R |
| 2,669,017 | 2/1954 | Seko | 30/41 |
| 4,074,428 | 2/1978 | Roberts | 30/41 |
| 4,234,087 | 11/1980 | Pandak | 220/23.4 |
| 4,332,321 | 6/1982 | Wratschko | 206/228 |
| 4,336,815 | 6/1982 | Ross | 132/76.2 |

FOREIGN PATENT DOCUMENTS

| | | | |
|---|---|---|---|
| 192406 | 3/1919 | Canada | 132/80 R |
| 2428994 | 1/1980 | France . | |
| 2490084 | 3/1982 | France | 132/80 R |
| 440778 | 10/1948 | Italy | 206/823 |
| 155189 | 8/1932 | Switzerland . | |
| 235059 | 6/1925 | United Kingdom . | |
| 262682 | 12/1926 | United Kingdom . | |
| 384098 | 12/1932 | United Kingdom . | |
| 419495 | 11/1934 | United Kingdom . | |
| 611869 | 11/1948 | United Kingdom . | |
| 711017 | 6/1954 | United Kingdom . | |
| 1340475 | 12/1973 | United Kingdom . | |

*Primary Examiner*—William T. Dixson, Jr.
*Assistant Examiner*—Brenda J. Ehrhardt
*Attorney, Agent, or Firm*—Wood, Dalton, Phillips, Mason & Rowe

[57] ABSTRACT

A hygiene implement comprises a toothbrush portion (21) and a razor portion (3,8), attachable to a respective end of a body portion (1).

End caps (4, 5) are provided which house the toothbrush portion and razor portion respectively when the implement is not in use. One of the end caps (4) has a clip (6) by means of which the implement may be attached to the clothing of a wearer.

The implement is particularly useful for persons travelling at short notice as it can provide all the necessary requirements for shaving and cleaning the teeth in a compact form.

7 Claims, 16 Drawing Figures

HYGIENE IMPLEMENT

The present invention relates to a hygiene implement.

It is known to provide separately so-called "travelling" toothbrushes and razors. "Travelling" toothbrushes may be provided with two parts: a toothbrush part, resembling an ordinary toothbrush with a shortened handle; and a housing part which, for travelling purposes, houses the toothbrush and which can be used as an extension for the handle of the toothbrush when the toothbrush is to be used.

Travelling razors usually have a handle and razor head, with a blade holding portion for holding a blade.

Hitherto there has been no implement which combines the functions of a razor and a toothbrush in a compact form.

In accordance with the present invention there is provided a hygiene implement comprising a toothbrush portion and a razor portion, the toothbrush portion being connected or connectible directly or indirectly to the razor portion: the toothbrush portion comprising a toothbrush head and a toothbrush head supporting region; and the razor portion comprising a razor head and a razor head supporting region; wherein the implement further includes one or more housing portions which, when the implement is not in use, house the said toothbrush and razor portions.

In accordance with a first embodiment of the present invention, the implement further comprises a body portion to one end region of which the toothbrush portion is connected or connectible, and to the other end region of which the razor portion is connected or connectible; wherein, when the implement is in use, the body portion may serve as a handle.

In accordance with a second embodiment of the present invention, the toothbrush portion and the razor portion are substantially in alignment with each other and parallel to the housing portion(s), the toothbrush head being located at one end region of the housing portion(s) and the razor head being located at the opposite end region of the housing portion(s) when the implement is not in use; wherein the toothbrush portion and the razor portion are movable, in a direction which is substantially parallel to the housing portion(s), with respect to the housing portion(s), so as to expose a desired one of said portions for use.

Preferably, the housing portion is provided with a slot, and one of the toothbrush portion and the razor portion is provided with a protrusion which, with the toothbrush portion and the razor portion housed in the housing portion, protrudes through the slot whereby the toothbrush portion and the razor portion can be moved with respect to the housing portion.

In accordance with a third embodiment of the present invention the body portion is open on one face, the toothbrush portion is pivotally connected to one end region of the body portion, and the razor portion is pivotally connected to the said one or the opposite end region of the body portion; wherein, when the implement is not in use, the toothbrush portion and the razor portion lie in generally side by side relationship within the body portion, and, in use, the toothbrush portion or razor portion may be pivoted out from the interior of the body portion to project beyond the body portion.

The razor head may be pivotable, with respect to the razor head supporting region, between a first position, wherein a major dimension of the razor head is generally perpendicular to the length of the razor head supporting region, and a second position, wherein the major dimension of the razor head is substantially parallel to the length of the razor head supporting region.

In order that the implement may be attached to the clothing of a user, there may be associated with each of the razor portion and the toothbrush portion a respective housing portion, one of the said housing portions being provided with attachment means.

For a better understanding of the present invention, and to show how the same may be carried into effect, reference will now be made, by way of example, to the accompanying drawings, in which.

The first embodiment will now be described with reference to FIGS. 1 to 10.

Figure 1:
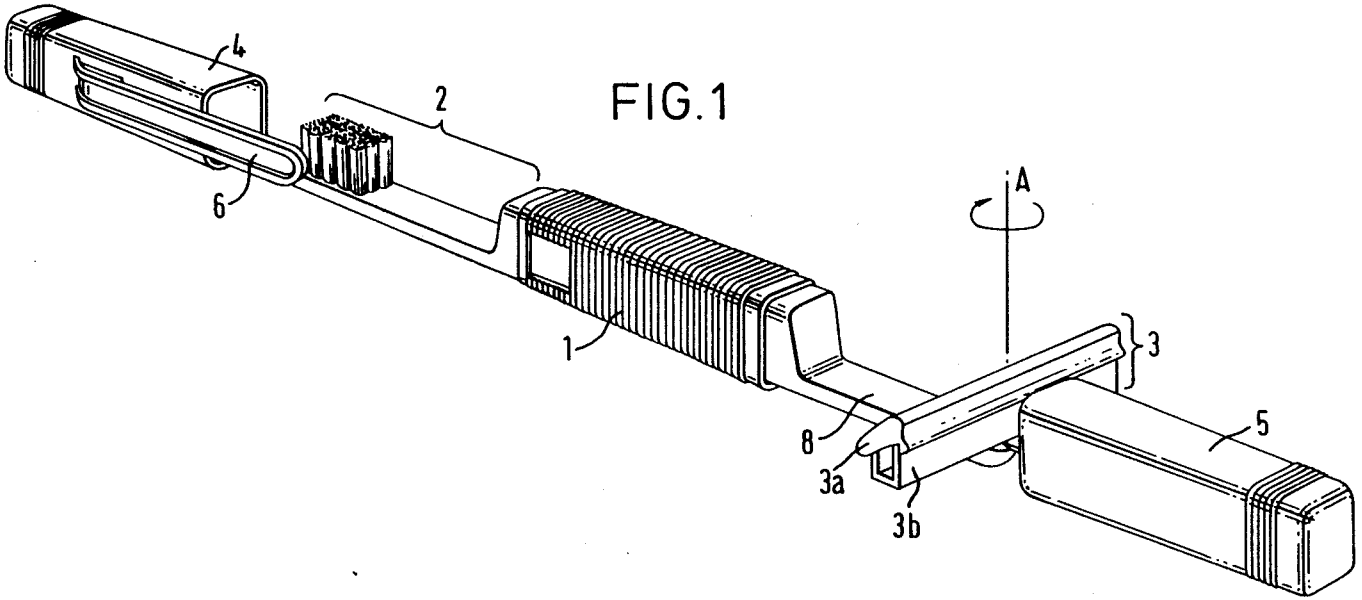
FIG. 1 shows a perspective view of the first embodiment of a toothbrush razor implement in accordance with the present invention, with end caps having been removed.
Figure 2:
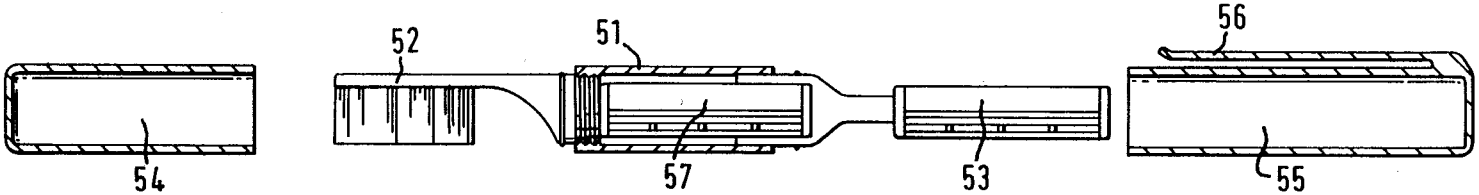
FIG. 2 is a side view of a modified first embodiment of the toothbrush razor implement according to the present invention, similar to that shown in FIG. 1.

FIG. 1 shows a central body 1 which in use can serve as a handle and to which is attached: at one end thereof, a toothbrush portion 2; and at the other end thereof a razor head 3. The razor head 3 is pivotable in the direction of arrow A in a manner which will be described more fully hereinafter. When the toothbrush portion 2 is not in use, a cap 4 can be placed over the portion 2, the cap 4 being releasably engaged by the body 1 in a known manner. The toothbrush portion 2 may be attached to the housing in some easily releasable manner, for example by a clip (or by screwing as shown in FIG. 2), so that the body 1 may be used to store a spare razor, or spare razor blades. The cap 4 could similarly be used to store toothpaste.

In FIG. 1, the razor head 3 is shown in an operational position, with a cap 5 ready for placing over the razor head 3 when the razor head 3 has been pivoted into alignment with the body 1 and toothbrush portion 2. The end cap 4 is provided with a clip 6 so that the implement can, when not in use, be attached to, for example, a jacket pocket in a similar manner to a pen.

The razor head 3 comprises two main parts; a blade holder 3*a*, which holds a razor blade in a position suitable for use of the implement as a razor; and a blade holder supporting member 3*b* which is detachably connected to the blade holder 3*a*.

FIG. 2 is a side view of a modified first embodiment of the toothbrush razor implement, similar to FIG. 1, the only differences being that end cap 55 is provided with a clip 56, corresponding to clip 6 on cap 4 in FIG. 1, and that the toothbrush portion 52 can be screwed into the body 51. A spare razor 57, housed in the body 51, is shown in FIG. 2. The components 53 and 54 correspond to components 3 and 4 in FIG. 1.

Spare razor blades may be stored on an injector type track which simultaneously ejects a used blade and replaces it with a new blade.

Figure 3:
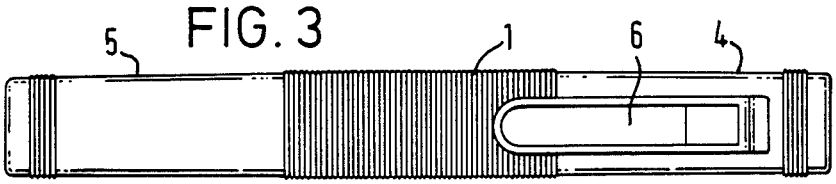
FIGS. 3 and 4 are a side view and plan view respectively of the toothbrush razor implement of FIG. 1, with the end caps in position.
Figure 4:
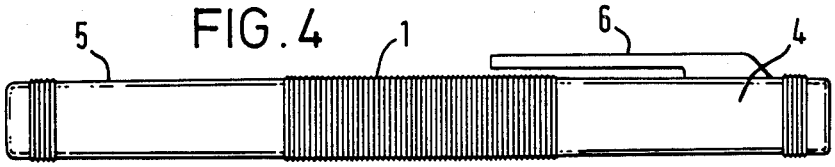

The toothbrush razor implement of FIG. 1 with the end caps 4 and 5 in position is shown in FIGS. 3 and 4.

Figure 5:
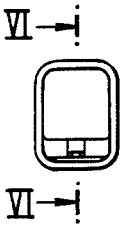
FIG. 5 is an end elevation of the main body and razor head supporting region of the toothbrush razor implement of FIG. 1.
Figure 6:
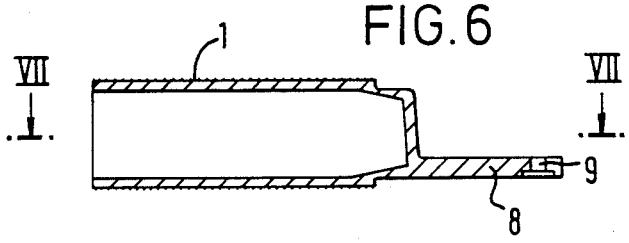
FIG. 6 is a section taken along line VI—VI of FIG. 5.
Figure 7:
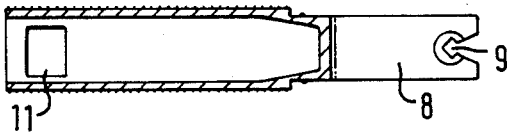
FIG. 7 is a section taken along line VII—VII of FIG. 6.

The pivoting arrangement for the razor head 3 will now be described with reference to FIGS. 5 to 7.

The razor head 3 is supported by a supporting portion 8 extending from the body 1. This supporting portion 8 is provided with a recess 9 which receives a corresponding square cross-section protrusion on the base of the blade holder supporting member 3*a* of the razor head 3. The razor head 3 can thus be secured in one of two positions, namely: in alignment with the main body 1; or perpendicular to the main body 1; and may be pivoted between the two positions and "clicked" into the desired position by way of this protrusion and recess arrangement.

Figure 8:
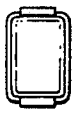
FIG. 8 is an end elevation, taken from the right hand end, of the toothbrush portion of the implement.
Figure 9:
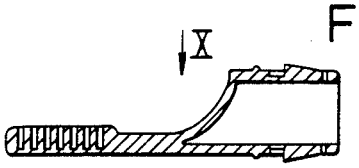
FIG. 9 is a vertical section along the length of the toothbrush portion of FIG. 8.
Figure 10:
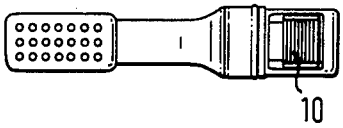
FIG. 10 is a view, taken in the direction of the arrow X of FIG. 9, of the toothbrush portion.
Figure 12:
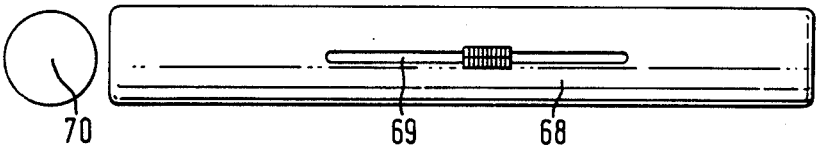
FIG. 12 shows the implement of FIG. 11 including the housing.

FIGS. 8 to 10 show the toothbrush portion 2 of the implement. This toothbrush portion 2 may be attached to the main body 1 by way of a protrusion 10 on the toothbrush portion 2 co-operating with a hole 11 on the main body 1.

It will be appreciated that when the end caps 4 and 5 are in position (FIGS. 3 and 4) the implement resembles a pen, which can be clipped on to a pocket in the same way as a normal ball point pen. The pivot or twist mechanism hereinbefore described enables the razor head 3 to swivel into a safe position, which can be maintained while the implement is being carried in the pocket. Single or multiple moulded heads can be used; and any type of suitable tracking or clip arrangement. This portable implement can be produced as two separate components, i.e. a toothbrush portion and a razor portion. Each portion may be produced as a completely disposable unit or as a reuseable unit. One embodiment allows the user to shave as has been done in the past with the so-called "cut-throat" type razor using the same caution as was used for this particular razor. However, in the embodiment hereinbefore described a "T" type blade is released from the main body 1, and refixed into a "T" position using a pivoting head. The toothbrush portion 2 can be removed to facilitate the removal of a stored blade when required.

Figure 11:
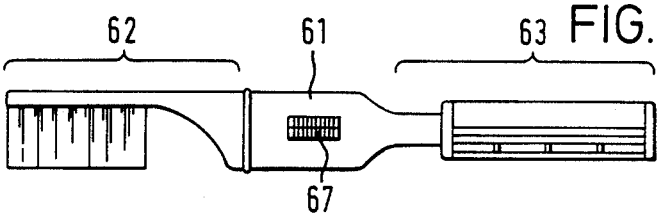
FIG. 11 shows a side view of the second embodiment of a toothbrush razor implement according to the present invention without showing the housing portion.
Figure 13:
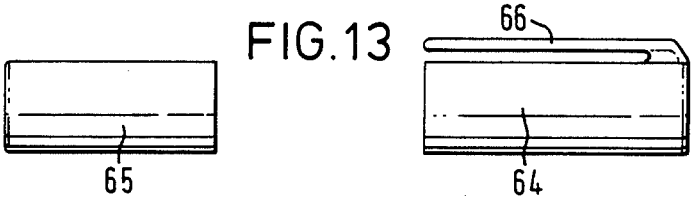
FIG. 13 shows end caps, like those of the embodiment shown in FIG. 2, which may be used to house those components of the implement shown in FIG. 11.

The second embodiment will now be described with reference to FIGS. 11 to 14. FIG. 11 shows an implement having a toothbrush portion 62 and a razor portion 63. A central portion 61 carries a protrusion 67. When the implement is housed in the housing 68, shown in FIG. 12, the protrusion extends through a groove 69 in the housing 68 and provides means for moving the toothbrush and razor portions 52, 53 along the length of the housing. The housing 68 may be provided with removable end regions, such as plugs 70. The dimensions are such that, with the protrusion 67 at the left hand end of the groove 69 in FIG. 12, the toothbrush portion 62 is exposed for use; and with the protrusion 67 at the right hand end of the groove 69 the razor portion 63 is exposed for use. Alternatively, the housing may comprise two force-fit end caps 64, 65 as described with reference to FIG. 1, with a gap between the end caps, when they are in position, for accommodating any protrusion like that 67. These end caps 64, 65 may be used in addition to the housing 68, fitting over the ends of the housing 68 in place of the plugs 70. When a grip such as that designated by reference numeral 80 (FIG. 14) is present, the end caps 64, 65 are conveniently held in place by the grip 80.

Figure 14:
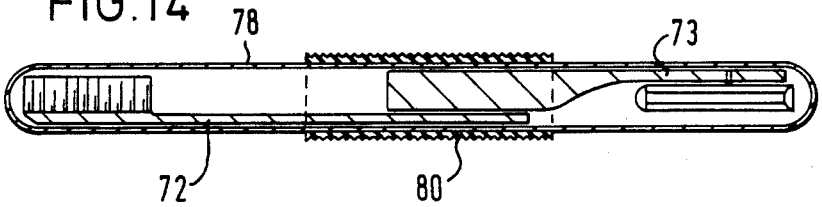
FIG. 14 shows a diagrammatic view of another implement according to the second embodiment of the present invention.

FIG. 14 shows another type of implement according to the second embodiment of the invention, with the toothbrush and razor portions 72, 73 housed in the housing 78. The housing 78 is provided with a rubber grip 80, in its central region, which can serve as a handle in use of the implement.

The second embodiment of the implement is designed as a disposable unit for use once only, and may be dispensed, for example, from vending machines in airports or stations.

Figure 15:
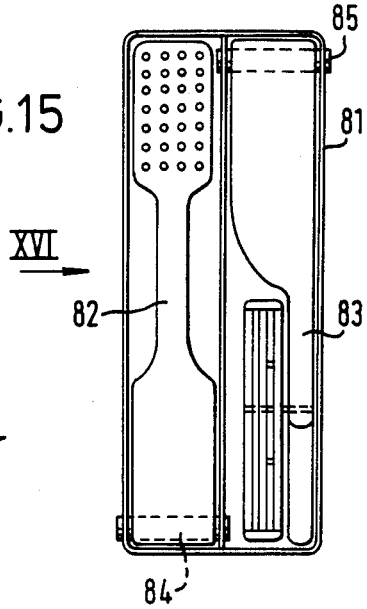
FIG. 15 is a plan view of an implement according to the third embodiment of the present invention, with its housing portion having been removed.
Figure 16:
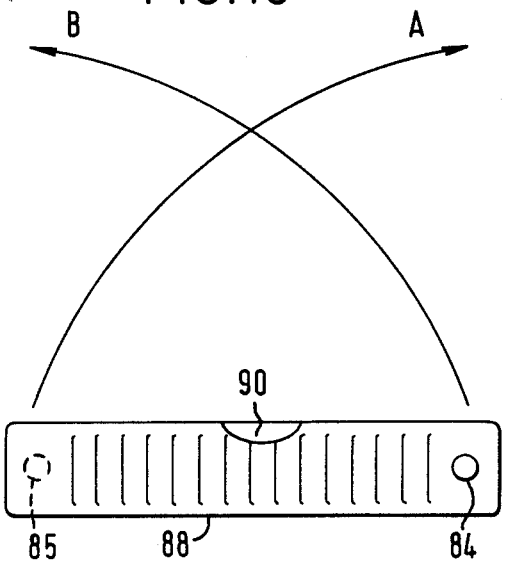
FIG. 16 is a side view of the implement of FIG. 15, looking in the direction of arrow XVI.

The third embodiment will now be described with reference to FIGS. 15 and 16. FIG. 15 shows a toothbrush portion 82, and razor portion 83 side by side in a box shaped container 8 which constitutes a body portion. The toothbrush portion 82 is hinged, at one end of the container 81, at a hinge 84; and the razor portion 83 is hinged, at the other end of the container 81 at a hinge 85. For use, the desired portion is pivoted out of the container 81 (in the direction of arrow A for the toothbrush portion 82, and in the direction of arrow B for the razor portion 83, which then serves as a handle. The container 81 may be provided with a grip 90 for this purpose. The implement may be housed in a housing (not shown) like a sleeve such as that which is normally utilised for matchboxes.

In any of the above-described embodiments, the toothbrush portion may be made of a tough rubber to allow flexibility of the toothbrush head and/or the toothbrush head may be pivotable so that, in use of the implement, the handle portion will not serve as an obstruction for a user. This implement is very useful for persons travelling without notice and unprepared, as they can carry the necessities for shaving and cleaning their teeth in their pocket with the same ease as a ball point pen. The implement can also be used after meals in restaurants, camping, office, aircraft and car; it is hygienic, simple and the various components (blade, toothbrush, toothpaste) are easily available.

I claim:

1. A hygiene implement comprising:

a toothbrush portion comprising a toothbrush head and toothbrush head supporting means;

a razor portion comprising a razor head and razor head supporting means;

a hollow body portion defining opposite ends;

first connecting means connecting the toothbrush head supporting means to one end of the body portion;

second connecting means connecting the razor head supporting means to the other end of the body portion, one of said connecting means comprising removable connecting means permitting access to the interior of said hollow body as an incident of removal of the supporting portion therefrom;

first housing means for removably housing the toothbrush portion;

second housing means for removably housing the razor portion, said first housing means completely surrounding the toothbrush portion and the second housing means completely surrounding the razor portion when the implement is not in use and which, when the implement is in use, can be moved away from the body portion so as selectively to expose at least one of the toothbrush portion and the razor portion for use, said body portion having a length preselected to permit it to be used as the manipulating handle for the implement when used either as a toothbrush or razor, said housing means extending in encircling relationship to the ends of the body portion defining a handle extension thereof; and means on said first housing means for supporting the implement.

2. A hygiene implement as claimed in claim 1 wherein the toothbrush portion, the razor portion and the body portion are substantially in alignment with each other and parallel to the housing means.

3. A hygiene implement as claimed in claim 1 wherein means connect the razor head pivotally with respect to the razor head supporting means, between a first position, wherein a major dimension of the razor head is generally perpendicular to the length of the razor head supporting means, and a second position, wherein the major dimension of the razor head is substantially parallel to the length of the razor head supporting means.

4. The hygiene implement of claim 1 wherein said means on the first housing means for supporting the implement to the user's clothing extends into overlying relationship with the body portion.

5. A hygiene implement comprising:

a toothbrush portion comprising a toothbrush head and toothbrush head supporting means;

a razor portion comprising a razor head and razor head supporting means;

a body portion;

connecting means connecting the toothbrush and razor portions to the body portion;

housing means separate from the connecting means removably housing the toothbrush portion and the razor portion when the implement is not in use and which, when the implement is in use, at least one of which is selectively removed from the body portion so as to expose at least the corresponding one of the toothbrush portion and the razor portion for use; and attachment means on said housing means defining means for attaching one of the housing means and thereby the implement to the clothing of a user.

6. The hygiene implement of claim 5 wherein said body portion is hollow and at least one of said connecting means is selectively releasable to provide access to the interior of said body portion.

7. The hygiene implement of claim 5 wherein said attachment means extends into overlying relationship with the body portion.

* * * * *